US005890544A

United States Patent [19]

Love et al.

[11] Patent Number: 5,890,544

[45] Date of Patent: Apr. 6, 1999

[54] SELF-CONTAINED REMOTE AUTOMATED FIRE SUPPRESSION

[76] Inventors: Robert Love; E Douglas Webber, both of 2745 St George Ave, North Vancouver, BC, Canada, V7N 1T8

[21] Appl. No.: 15,101

[22] Filed: Jan. 28, 1998

[51] Int. Cl.[6] ..... A62C 25/00

[52] U.S. Cl. ..... 169/51; 312/242; 312/245

[58] Field of Search ..... 161/51; 312/242, 312/245, 350, 351; 52/27, 29

[56] References Cited

U.S. PATENT DOCUMENTS

| | | | |
|---|---|---|---|
| 3,067,822 | 12/1962 | Hattenhauer | 169/51 |
| 3,220,791 | 11/1965 | Pokryfke | 312/242 |
| 3,722,733 | 3/1973 | Neumann | 312/242 |
| 4,034,697 | 7/1977 | Russell | 116/100 |
| 4,046,439 | 9/1977 | Lee | 312/138 R |
| 4,272,137 | 6/1981 | Rothhaas et al. | 312/242 |
| 4,449,588 | 5/1984 | Benlolo | 169/48 |
| 4,763,732 | 8/1988 | Neal | 169/51 |
| 4,998,587 | 3/1991 | Thomas | 169/51 |
| 5,171,079 | 12/1992 | Bayerle | 312/409 |
| 5,638,907 | 6/1997 | Salmonsen et al. | 169/51 |

FOREIGN PATENT DOCUMENTS

| | | | |
|---|---|---|---|
| 2 173 099 | 10/1986 | United Kingdom | 169/51 |

*Primary Examiner*—Andres Kashnikow
*Assistant Examiner*—Lisa Ann Douglas

[57] ABSTRACT

A fire extinguisher system is provided including a wall mount with an open front. The wall mount is adapted to be situated within an opening formed in a recipient surface such that the open front is in coplanar relationship therewith. Next provided is a housing having a closed front face with an aperture formed therein. A fire extinguisher is provided having an actuation assembly adapted to release the fire extinguishing material upon the detection of a temperature above a predetermined amount. The fire extinguisher is situated within the housing with the actuation assembly protruding from the aperture thereof. During use, the housing may be removably situated within the wall mount with the front face of the housing remaining in coplanar relationship with the open front of the wall mount.

7 Claims, 2 Drawing Sheets

SELF-CONTAINED REMOTE AUTOMATED FIRE SUPPRESSION

BACKGROUND OF THE INVENTION

1. Field of the Invention

The present invention relates to fire extinguishers and more particularly pertains to a new self-contained, remote, automated fire suppression system for mounting a self-contained fire extinguisher to a receipt surface such as a wall or ceiling.

2. Description of the Prior Art

The use of fire extinguishers is known in the prior art. More specifically, fire extinguishers heretofore devised and utilized are known to consist basically of familiar, expected and obvious structural configurations, notwithstanding the myriad of designs encompassed by the crowded prior art which have been developed for the fulfillment of countless objectives and requirements.

Known prior art fire extinguishers include U.S. Pat. No. 5,441,113; U.S. Pat. No. 5,145,014; U.S. Pat. No. 5,127,479; U.S. Pat. No. 5,096,124; U.S. Pat. No. 5,113,945; and U.S. Pat. No. Des 251,464.

In these respects, the self-contained, remote, automated fire suppression system according to the present invention substantially departs from the conventional concepts and designs of the prior art, and in so doing provides an apparatus primarily developed for the purpose of mounting a self-contained fire extinguisher to a receipt surface such as a wall or ceiling.

SUMMARY OF THE INVENTION

In view of the foregoing disadvantages inherent in the known types of fire extinguishers now present in the prior art, the present invention provides a new self-contained, remote, automated fire suppression system construction wherein the same can be utilized for mounting a self-contained fire extinguisher to a receipt surface such as a wall or ceiling.

The general purpose of the present invention, which will be described subsequently in greater detail, is to provide a new self-contained, remote, automated fire suppression system apparatus and method which has many of the advantages of the fire extinguishers mentioned heretofore and many novel features that result in a new self-contained, remote, automated fire suppression system which is not anticipated, rendered obvious, suggested, or even implied by any of the prior art fire extinguishers, either alone or in any combination thereof.

To attain this, the present invention generally comprises a wall mount with a rectangular rear face and a periphery integrally coupled to a perimeter of the rear face and extending forwardly therefrom. As such, the wall mount defines an interior space and an open front. The open front has a peripheral edge with an all-encompassing flange extending therefrom. The wall mount is adapted to be situated within a rectangular opening formed in a recipient surface and further secured to an adjacent stud. FIG. 1 shows a housing including a rectangular front face and a periphery integrally coupled to a perimeter of the front face and extending rearwardly therefrom, thereby defining an open rear face. The periphery of the housing is defined by a square top face, a square bottom face, and a pair of rectangular side faces. The front face has a circular aperture formed therein adjacent a top thereof. A pair of generally C-shaped bottom guides are each coupled to an associated one of the side faces within the interior space of the housing at a common elevation. The bottom guides extend between the front face and open rear face, as shown in FIG. 1. A generally C-shaped top guide is coupled to the top face of the periphery within the interior space. Such top guide extends between the front face and open rear face. Next provided is a fire extinguisher having a cylindrical configuration. The fire extinguisher is equipped with a top end having an actuation assembly. Such actuation assembly extends in perpendicular relationship with an axis about which the fire extinguisher is situated. The actuation assembly has a gauge situated on the inboard end thereof for displaying a charged operating pressure of the extinguisher. During use, the actuation assembly serves to release the fire extinguishing material from an outboard end thereof upon the detection of a temperature above a predetermined amount. For reasons that will become apparent hereinafter, the actuation assembly has a tab extending upwardly therefrom along the axis. A fire extinguisher containment assembly is provided including a square planer lower base and a cylindrical container integrally coupled to the base and extending upwardly therefrom. The container assembly is adapted to releasably receive the fire extinguisher therein. As such, the lower base of the containment assembly may be slidably situated between the bottom guides and the tab of the fire extinguisher slidably situated within the top guide of the housing. In such orientation, the outboard end of the actuation assembly of the fire extinguisher extends through the aperture of the housing. During use, the housing may be situated within the wall mount such that the front face of the housing is in coplanar relationship with the recipient surface.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new self-contained, remote, automated fire suppression system apparatus and method which has many of the advantages of the fire extinguishers mentioned heretofore and many novel features that result in a new self-contained, remote, automated fire suppression system which is not anticipated, rendered obvious, suggested, or even implied by any of the prior art fire extinguishers, either alone or in any combination thereof.

It is another object of the present invention to provide a new self-contained, remote, automated fire suppression system which may be easily and efficiently manufactured and marketed.

It is a further object of the present invention to provide a new self-contained, remote, automated fire suppression system which is of a durable and reliable construction.

An even further object of the present invention is to provide a new self-contained, remote, automated fire suppression system which is susceptible of a low cost of manufacture with regard to both materials and labor, and which accordingly is then susceptible of low prices of sale to the consuming public, thereby making such self-contained, remote, automated fire suppression system economically available to the buying public.

Still yet another object of the present invention is to provide a new self-contained, remote, automated fire suppression system which provides in the apparatuses and methods of the prior art some of the advantages thereof, while simultaneously overcoming some of the disadvantages normally associated therewith.

Still another object of the present invention is to provide a new self-contained, remote, automated fire suppression system for mounting a self-contained fire extinguisher to a receipt surface such as a wall or ceiling.

Even still another object of the present invention is to provide a new self-contained, remote, automated fire suppression system that includes a wall mount with an open front. The wall mount is adapted to be situated within an opening formed in a recipient surface such that the open front is in coplanar relationship therewith. Next provided is a housing having a closed front face with an aperture formed therein. A fire extinguisher is provided having an actuation assembly adapted to release the fire extinguishing material upon the detection of a temperature above a predetermined amount. The fire extinguisher is situated within the housing with the actuation assembly protruding from the aperture thereof. During use, the housing may be removably situated within the wall mount with the front face of the housing remaining in coplanar relationship with the open front of the wall mount.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
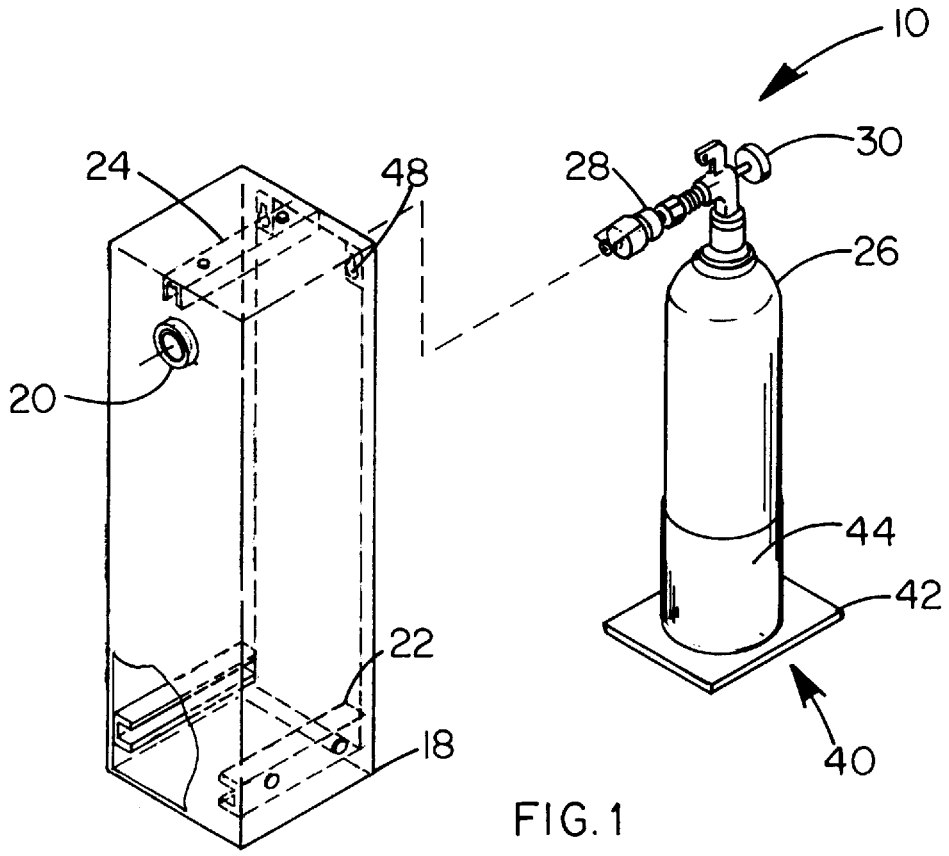
FIG. 1 is a perspective view of a new self-contained, remote, automated fire suppression system according to the present invention.
Figure 2:
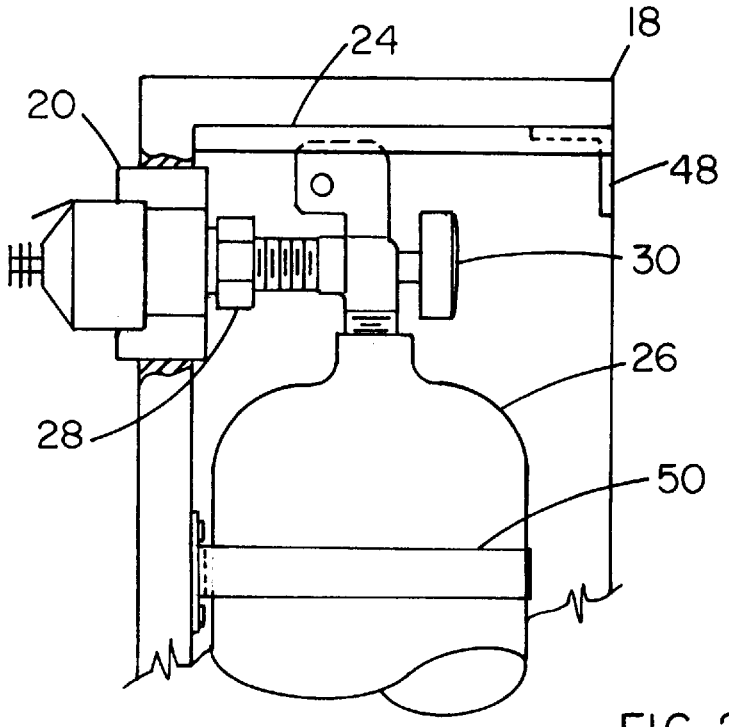
FIG. 2 is a close-up view of the fire extinguisher and housing of the present invention.
Figure 3:
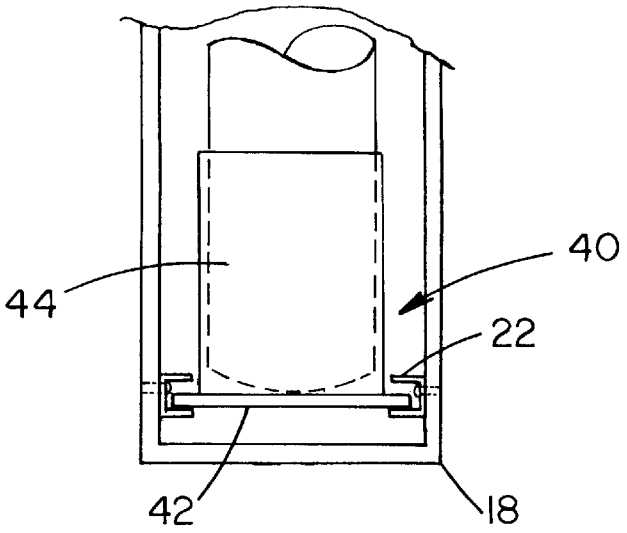
FIG. 3 is a rear view of the housing and fire extinguisher containment assembly of the present invention.
Figure 4:
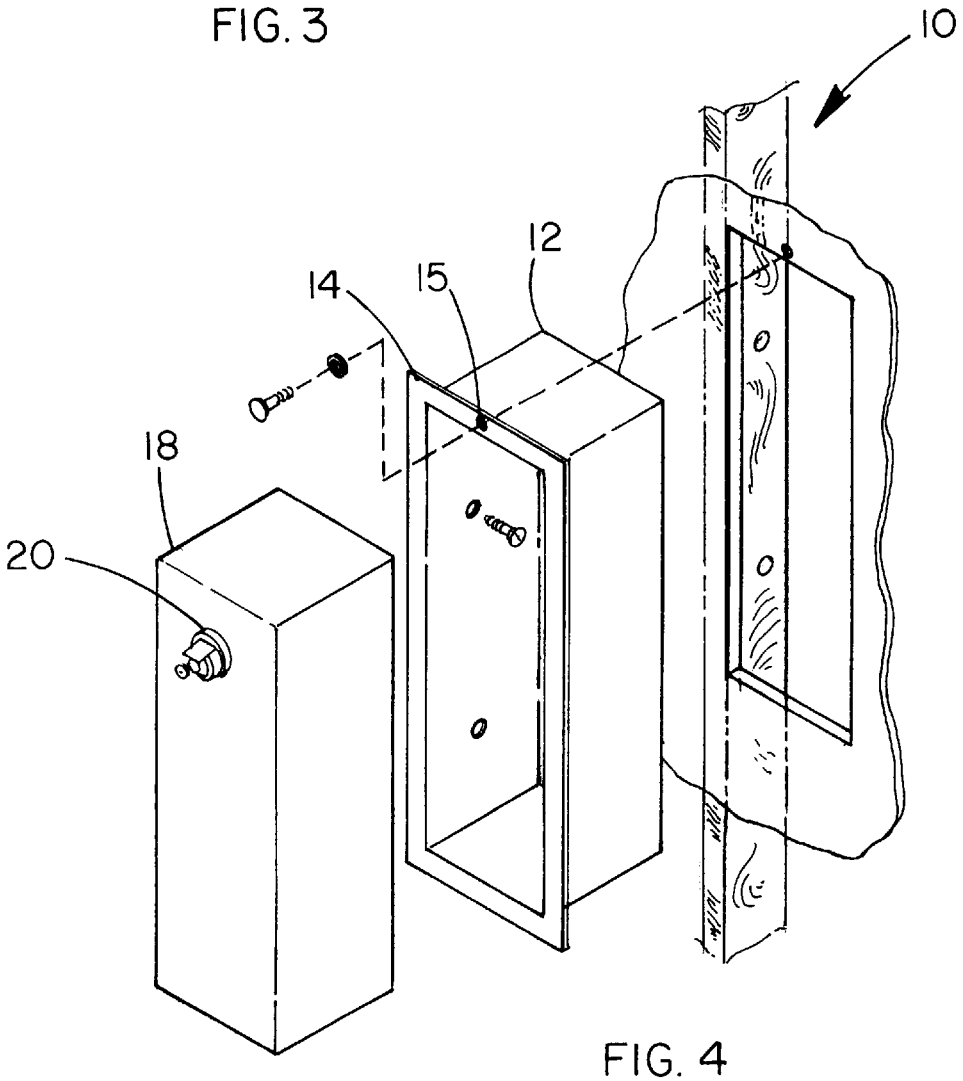
FIG. 4 is an exploded view of the present invention.

With reference now to the drawings, and in particular to FIGS. 1 through 4 thereof, a new self-contained, remote, automated fire suppression system embodying the principles and concepts of the present invention and generally designated by the reference numeral 10 will be described.

The present invention, as designated as numeral 10, includes a wall mount 12 with a rectangular rear face and a periphery integrally coupled to a perimeter of the rear face and extending forwardly therefrom. As such, the wall mount defines an interior space and an open front. The open front has a peripheral edge with an all-encompassing flange 14 extending therefrom. The flange preferably has screw holes 15 formed therein. The wall mount is adapted to be situated within a rectangular opening formed in a recipient surface and further secured to an adjacent stud. Such is accomplished by way of a pair of apertures formed in side face of the periphery for situating screws therethrough.

FIG. 1 shows a housing 18 including a rectangular front face and a periphery integrally coupled to a perimeter of the front face and extending rearwardly therefrom, thereby defining an open rear face. The periphery of the housing is defined by a square top face, a square bottom face, and a pair of rectangular side faces. The front face has a circular aperture 20 formed therein adjacent a top thereof. A pair of generally C-shaped bottom guides 22 are each coupled to an associated one of the side faces within the interior space of the housing at a common elevation. The bottom guides extend between the front face and open rear face, as shown in FIG. 1. A generally C-shaped top guide 24 is coupled to the top face of the periphery within the interior space. Such top guide also extends between the front face and open rear face.

Next provided is a fire extinguisher 26 having a cylindrical configuration. The fire extinguisher is equipped with a top end having an actuation assembly 28. Such actuation assembly extends in perpendicular relationship with an axis about which the fire extinguisher is formed. The actuation assembly has a gauge 30 situated on the inboard end thereof for displaying a charged operating pressure of the extinguisher. Yet another component of the actuation assembly is a plug valve for facilitating the charging/recharging of the cylinder and for enabling the activation of the system after assembly.

During use, the actuation assembly serves to release the fire extinguishing material from an outboard end thereof upon the detection of a temperature above a predetermined amount. It should be noted that the outboard end of the actuation assembly is equipped with a dry-chemical type sprinkler head, as presently commercially available, with a calibrated heat-sensitive glass capsule which under, the specified temperature ruptures, and releases the fire retarding chemical in a pre-set pattern determined by the configuration of the sprinkler head, over the flammable target.

For reasons that will become apparent hereinafter, the actuation assembly has a tab extending upwardly therefrom along the axis. Such tab is rotatable and allows the dispensing of the fire extinguishing material only when in a certain orientation.

A fire extinguisher containment assembly 40 is provided including a square planer lower base 42 and a cylindrical container 44 integrally coupled to the base and extending upwardly therefrom. The container assembly is adapted to releasably receive the fire extinguisher therein. As such, the lower base of the containment assembly may be slidably situated between the bottom guides and the tab of the fire extinguisher slidably situated within the top guide of the housing. It should be noted that the tab will only fit within the narrow top guide if it is in the orientation which permits the proper operation of the fire extinguisher.

When the fire extinguisher containment assembly is situated within the housing, the outboard end of the actuation assembly of the fire extinguisher extends through the aperture of the housing. During use, the housing may be situated within the wall mount such that the front face of the housing is in coplanar relationship with the recipient surface. To maintain the housing within the wall mount, a pair of hanging apertures 48 may be situated adjacent the open rear face thereof for releasably mounting the heads of a pair of nails within the wall mount.

To further ensure that the fire extinguisher remains fixed with respect to the housing, especially during use, the housing has a closed loop strap 50 connected to the front face. Such strap encompasses an upper extent of the fire extinguisher for precluding the same from moving when the housing is removed from the wall mount and further during the dispensing of the fire extinguisher material.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A fire extinguisher system comprising:

a wall mount including an open front, wherein the wall mount is adapted to be situated within an opening formed in a recipient surface such that the open front is in coplanar relationship therewith;

a housing having a closed front face with an aperture formed therein; and a fire extinguisher having an actuation assembly adapted to release the fire extinguishing material upon the detection of a temperature above a predetermined amount, the fire extinguisher is situated within the housing with the actuation assembly protruding from the aperture thereof, whereby the housing may be removably situated within the wall mount with the front face of the housing remaining in coplanar relationship with the open front of the wall mount.

2. A fire extinguisher system as set forth in claim 1 wherein the housing has an open rear face for allowing the fire extinguisher to be removed therefrom.

3. A fire extinguisher system as set forth in claim 1 wherein the fire extinguisher is situated within a containment assembly which is in turn slidably situated within the housing.

4. A fire extinguisher system as set forth in claim 3 wherein the housing has a plurality of guides formed therein for facilitating the sliding of the containment assembly within the housing.

5. A fire extinguisher system as set forth in claim 1 wherein the fire extinguisher is self contained.

6. A fire extinguisher system as set forth in claim 1 wherein the actuation assembly has a gauge for displaying a charged operating pressure of the extinguisher.

7. A fire extinguisher system comprising, in combination:

a wall mount including a rectangular rear face and a periphery integrally coupled to a perimeter of the rear face and extending forwardly therefrom for defining an interior space and an open front, the open front having a peripheral edge with an all-encompassing flange extending therefrom, wherein the wall mount is adapted to be situated within a rectangular opening formed in a recipient surface and further secured to an adjacent stud;

a housing including a rectangular front face and a periphery integrally coupled to a perimeter of the front face and extending rearwardly therefrom thereby defining an open rear face, the periphery of the housing defined by a square top face, a square bottom face, and a pair of rectangular side faces, the front face having a circular aperture formed therein adjacent a top thereof, a pair of generally C-shaped bottom guides each coupled to an associated one of the side faces within the interior space of the housing at a common elevation and extending between the front face and open rear face, a generally C-shaped top guide coupled to the top face of the periphery within the interior space and extending between the front face and open rear face;

a fire extinguisher having a cylindrical configuration with a top end having an actuation assembly extending in perpendicular relationship with an axis about which the fire extinguisher is situated, the actuation assembly having a gauge situated on the inboard end thereof for displaying a charged operating pressure of the extinguisher, the actuation assembly adapted to release the fire extinguishing material from an outboard end thereof upon the detection of a temperature above a predetermined amount, the actuation assembly further having a tab extending upwardly therefrom along the axis; and a fire extinguisher containment assembly including a square planer lower base and a cylindrical container integrally coupled to the base and extending upwardly therefrom, the container adapted to releasably receive the fire extinguisher therein such that the lower base of the containment assembly may be slidably situated between the bottom guides and the tab of the fire extinguisher is slidably situated within the top guide of the housing with the outboard end of the actuation assembly of the fire extinguisher extending through the aperture of the housing, whereby the housing may be situated within the wall mount such that the front face of the housing is in coplanar relationship with the recipient surface.

* * * * *